US010059073B2

(12) United States Patent
Yamada et al.

(10) Patent No.: US 10,059,073 B2
(45) Date of Patent: Aug. 28, 2018

(54) SINGLE FACER

(71) Applicant: KABUSHIKI KAISHA ISOWA, Nagoya-shi, Aichi (JP)

(72) Inventors: Takahiro Yamada, Kasugai (JP); Hisashi Hayashi, Kiyosu (JP); Naoki Mori, Komaki (JP)

(73) Assignee: KABUSHIKI KAISHA ISOWA, Nagoya-shi, Aichi (JP)

( * ) Notice: Subject to any disclaimer, the term of this patent is extended or adjusted under 35 U.S.C. 154(b) by 0 days.

(21) Appl. No.: 15/364,370

(22) Filed: Nov. 30, 2016

(65) Prior Publication Data

US 2017/0173914 A1 Jun. 22, 2017

(30) Foreign Application Priority Data

Dec. 18, 2015 (JP) ..... 2015-247425

(51) Int. Cl.
*B31F 1/28* (2006.01)

(52) U.S. Cl.
CPC ..... *B31F 1/2868* (2013.01); *B31F 1/2895* (2013.01)

(58) Field of Classification Search
CPC ..... B31F 1/2868
See application file for complete search history.

(56) References Cited

U.S. PATENT DOCUMENTS 9,193,127 B2 11/2015 Yamada et al.
2015/0030713 A1* 1/2015 Yamada ..... B31F 1/20 425/336

FOREIGN PATENT DOCUMENTS

JP 2015-24577 A 2/2015

* cited by examiner

*Primary Examiner* — Barbara J Musser
(74) *Attorney, Agent, or Firm* — Brinks Gilson & Lione

(57) ABSTRACT

Disclosed is a single facer which comprises: a cartridge pivotally supporting a pair of corrugating rolls by a side plate; two cartridges pivotally supporting a pair of corrugating rolls by a side plate, respectively; a single facer body housing the two cartridges in a movable manner so as to exchange respective setup positions of the two cartridges between the in-use position and the rest position; and a hydraulic jack disposed just below the stacked cartridges in a vertical direction and configured to push the stacked cartridges upwardly, wherein, by pushing the stacked cartridges upwardly by the hydraulic jack, the single facer is operable to press an upper end of the side plate of the upper cartridge against a lower end of a ceiling member of the single facer body, so as to clamp the stacked cartridges by the hydraulic jack and the ceiling member of the single facer body.

7 Claims, 9 Drawing Sheets

SINGLE FACER

RELATED APPLICATIONS

This application claims priority under 35 U.S.C. § 119 to Japanese Patent Application No. 2015-247425 filed on Dec. 18, 2015, the entire content of which is hereby incorporated by reference.

BACKGROUND OF THE INVENTION

Field of the Invention

The present invention relates to a single facer for bonding a linerboard to a corrugated medium formed in a flute configuration to produce a single-faced corrugated paperboard sheet, and particularly to a single facer for producing two types of single-faced corrugated paperboards having different flute configurations, while exchanging a set of two cartridges each having a corrugating roll pair.

Description of Related Art

Heretofore, there has been known a single facer for bonding a planar back linerboard to flute tips of a corrugated medium formed in a flute (waved flute) configuration to produce a single-faced corrugated paperboard sheet. Recent years, in order to meet a demand for producing a plurality of types of single-faced corrugated paperboard sheets having different flute configurations by a simplified exchanging operation, there has been developed a single facer capable of exchanging a set of two cartridges disposed within a single facer body so as to select one cartridge to be used, from the two carriages (see Patent Document 1 (JP 2015-024577A), for example). Patent Document 1 has a counterpart U.S. Pat. No. 9,193,127 B2.

In the single facer disclosed in the Patent Document 1, a clamp mechanism (34) is inserted into and locked to a lockable seat (15) of an upper one (1) of a set of two cartridges (1, 2) stacked in a vertical (upward-downward) direction, and the cartridges (1, 2) are pushed upwardly by a hydraulic jack 4 to cause a lower surface of the lockable seat (15) of the upper cartridge (1) to come into press contact with a lower surface of the clamp mechanism (34). In this way, the upper cartridge (1) is substantially clamped by the hydraulic jack (4) and the clamp mechanism (34) to restrict a vertical movement of the cartridges (1, 2).

BRIEF SUMMARY OF THE INVENTION

Technical Problem

Meanwhile, a single facer involves generation of a relatively large amount of heat. Thus, the single facer (100) disclosed in the Patent Document 1 has suffered from the following problems caused by heat generated in the single facer body. First, in the single facer (100), when the cartridges (1, 2) and the single facer body (3) are thermally deformed due to generated heat, an amount of thermal deformation in the cartridges (1, 2) is different from that in the single facer body (3). This is likely to lead to a situation where the clamp mechanism (34) of the single facer body (3) fails to be adequately inserted into the lockable seat (15) of the upper cartridge (1) located at a given position to be set during production of a single-faced corrugated paperboard sheet. Second, the thermal deformation also occurs in a state in which the clamp mechanism (34) is inserted in the lockable seat (15) of the upper cartridge (1). This is likely to lead to a situation where a movable shaft of the clamp mechanism (34) is displaced when the cartridges (1, 2) are pushed by the hydraulic jack (4) (e.g., an axis of the movable shaft is deviated from a horizontal direction). The displacement of the movable shaft of the clamp mechanism (34) causes a problem that the clamp mechanism (34) becomes failing to hold the upper cartridge (1) at an adequate position.

As above, in the single facer (100) disclosed in the Patent Document 1, under the influence of heat generated therein, there arises a problem of being unable to fix a pair of corrugating rolls (11, 12) of the in-use cartridge (1) during production of a single-faced corrugated paperboard sheet.

Moreover, in the single facer (100) disclosed in the Patent Document 1, the clamp mechanism (34) having a relatively small mass is used as a locking member to fix the cartridges (1, 2) to the single facer body (3). This is likely to lead to a situation where the clamp mechanism (34) undergoes deformation during prolonged use.

It is therefore an object of the present invention to provide a single facer capable of suppressing the influence of heat to allow a set of two cartridges stacked in a vertical direction during production of a single-faced corrugated paperboard sheet to be fixed stably in an adequate position.

Solution to Problem

In order to achieve the above object, the present invention provides a single facer for bonding a linerboard to a corrugated medium formed in a flute configuration to produce a single-faced corrugated paperboard sheet. The single facer includes: a set of two cartridges configured to be stacked in a vertical direction during a production of a single-faced corrugated paperboard sheet in such a manner that they alternately take an upper, in-use position and a lower, rest position, respectively, wherein: one of the two cartridges includes a pair of corrugating rolls for forming a single-faced corrugated paperboard sheet having a given flute configuration, and a side plate pivotally supporting the pair of corrugating rolls; and the other cartridge includes a pair of corrugating rolls for forming a single-faced corrugated paperboard sheet having a different flute configuration from that of the one cartridge, and a side plate pivotally supporting the pair of corrugating rolls; a single facer body housing the two cartridges in a movable manner so as to exchange respective setup positions of the two cartridges between the in-use position and the rest position; and a pushing device disposed just below the two cartridges stacked in the vertical direction and configured to push the stacked cartridges upwardly, wherein, by pushing the stacked cartridges upwardly by the pushing device, the single facer is operable to press an upper end of the side plate of an upper one of the stacked cartridges with respect to a lower end of a ceiling member of the single facer body, so as to clamp an entirety of the stacked cartridges by the pushing device and the ceiling member of the single facer body.

In the single facer of the present invention having the above feature, the entirety of the set of two cartridges stacked in the vertical direction is clamped by the pushing device and the ceiling member (as a heavy object) of the single facer body, so that the stacked cartridges can be stably fixed with respect to the single facer body to restrict a vertical movement of the stacked cartridges. This makes it possible to adequately suppress the influence of heat generated in the single facer. Specifically, in the technique described in the Patent Document 1, due to thermal deformation of the single facer body and the cartridges caused by heat generated in the single facer, there is a possibility that the cartridge cannot be fixed in an adequate position during production of a single-faced corrugated paperboard sheet. In contrast, the present invention employing the pushing device for pushing the stacked cartridges upwardly can adequately suppress the influence of thermal deformation, even if such thermal deformation occurs. More specifically, in the present invention, a vertical misalignment between the single facer body and the stacked cartridges caused by thermal deformation can be absorbed by adjusting a vertical movement of the pushing device. Therefore, the present invention makes it possible to suppress the influence of heat generated in the single facer to fix the stacked cartridges in an adequate position during production of a single-faced corrugated paperboard sheet.

Preferably, in the single facer of the present invention, the upper end of the side plate of each of the cartridges and the lower end of the ceiling member of the single facer body are formed with a positioning mechanism for positioning the upper cartridge with respect to the ceiling member of the single facer body when the pressing device pushes the stacked cartridges upwardly.

According to this feature, it becomes possible to adequately perform the positioning of the upper cartridge with respect to the single facer body by means of the positioning mechanism, when the pressing device pushes the stacked cartridges upwardly.

Preferably, in the above single facer, the positioning mechanism includes: a protruding portion formed at an edge of the upper end of the side plate of each of the cartridges; and a recessed portion formed on the lower end of the ceiling member of the single facer body at a position corresponding to the protruding portion, and configured to be engaged with the protruding portion, wherein both the protruding portion and the recessed portion are formed in taper shapes.

According to this feature, the taper-shaped protruding portion formed on the upper end of the side plate of the upper cartridge can be engaged with the taper-shaped recessed portion formed on the lower end of the ceiling member of the single facer body, so that it becomes possible to adequately perform the positioning of the upper cartridge with respect to the single facer, particularly, in a horizontal direction.

Preferably, in the above single facer, the upper end of the side plate of each of the cartridges is further formed with a flat portion at one edge opposite to the other edge formed with the protruding portion, as viewed in a sheet conveyance direction by the single facer, and the lower end of the ceiling member of the single facer body is further formed with a convex portion at a position corresponding to the flat portion, which is configured to come into surface contact with the flat portion when the pressing device pushes the stacked cartridges upwardly.

According to this feature, a contact between the upper end of the side plate of the upper cartridge and the lower end of the ceiling member of the single facer body occurring when the pressing device pushes the stacked cartridges upwardly is established by a contact in an engaged region between the protruding portion of the upper cartridge and the recessed portion of the ceiling member, and a surface contact between the flat portion of the upper cartridge and the convex portion of the ceiling member. This makes it possible to adequately clamp and fix the entirety of the stacked cartridges by the single facer body and the ceiling member, irrespective of thermal deformation of the single facer body and the two cartridges.

Preferably, in the single facer of the present invention, the single facer body is provided with a protrusion-shaped member movable forwardly and backwardly with respect to a lateral end of the side plate of the upper cartridge, and a distal end of the protrusion-shaped member comes into contact with the lateral end of the side plate when the protrusion-shaped member is in a protruded position, and the lateral end of the side plate of each of the cartridges is formed with a stepped portion which is located just above a position corresponding to the protrusion-shaped member, and which includes a surface spacedly opposed to an upper surface of the protrusion-shaped member being in the protruded position.

According to this feature, it becomes possible to adequately restrict a horizontal movement of the upper cartridge. In addition, the lateral end of the side plate of each of the two cartridges has a stepped portion formed such that it is located just above a position corresponding to the protrusion-shaped member, when the cartridge is in the in-use position. Thus, in a state in which a lower one of the stacked cartridges is retracted, and the upper cartridge is latched and held, even when the latching of the upper cartridge is released for some reason, the protrusion-shaped member is latched by the stepped portion of the upper cartridge, so that it becomes possible to prevent dropping of the upper cartridge. Further, the upper surface of the protrusion-shaped member being in the protruded position is located in spaced-apart relation to a lower surface of the stepped portion of the upper cartridge. Thus, even when the single facer body and the upper cartridge are thermally deformed, it becomes possible to suppress the problem occurring between the clamp mechanism and the lockable seat in the single facer disclosed in the Patent Document 1. Specifically, it becomes possible to adequately suppress a situation where the protrusion-shaped member and the stepped portion hinder the positioning of the upper cartridge with respect to the single facer body.

Preferably, the single facer of the present invention further includes: a vertically moving device for lifting and lowering the cartridges so as to alternately set up the cartridges in the in-use position and the rest position; a horizontally moving device for moving the cartridges in a horizontal direction parallel to a sheet conveyance direction by the single facer to temporarily retract the cartridge to a retraction position within the single facer body, so as to exchange vertical setup positions regarding the stacked cartridges; and a position sensor for detecting whether or not each of the two cartridges is set up by the horizontally moving device at a given horizontal position to be set up during the production of the single-faced corrugated paperboard sheet.

According to this features, it becomes possible to exchange the two cartridges between the in-use position and the rest position in a simplified manner. In addition, according to the above feature, the horizontally moving device can accurately set up each of the two cartridges in the given horizontal position by using the position sensor for detecting the horizontal position of the cartridge.

Preferably, in the above single facer, the horizontally moving device includes: a first moving device for moving one of the two cartridges between a lifting-lowering position for lifting and lowering the cartridge by the vertically moving device, and a first retracted sub-position of the retraction position on a downstream side in the sheet conveyance direction; and a second moving device for moving the other cartridge between the lifting-lowering position and a second retracted sub-position of the retraction position on an upstream side in the sheet conveyance direction, and both the first and second moving devices are provided in a bottom member of the single facer body, and configured to move the cartridge by a hydraulic cylinder.

According to this feature, each of the two cartridges is moved between the lifting-lowering position and a corresponding one of the two retraction positions by using the first and second moving devices, so that it becomes possible to efficiently exchange the two cartridges between the in-use position and the rest position. In addition, according to the above feature, each of the first and second moving devices is composed of a hydraulic cylinder, so that it becomes possible to adequately set up each of the two heavy cartridges in the given horizontal position, and adequately install the two moving devices in the bottom member of the single facer body limited in space.

The single facer of the present invention is capable of suppressing the influence of heat to allow the set of two cartridges vertically stacked during production of a single-faced corrugated paperboard sheet to be fixed stably in an adequate position.

DETAILED DESCRIPTION OF THE INVENTION

With reference to the accompanying drawings, a single facer according to one embodiment of the present invention will now be described.

Figure 1:
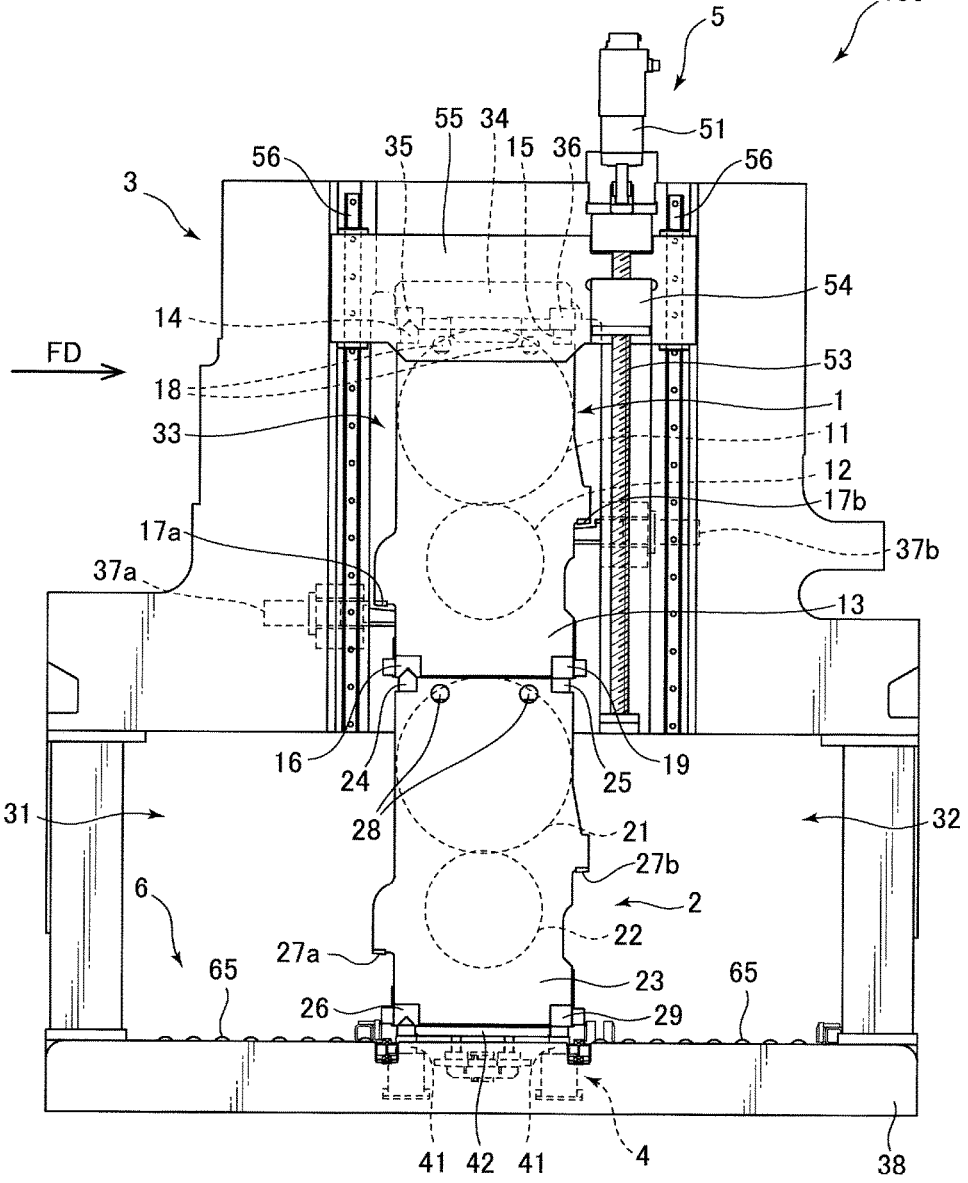
FIG. 1 is a front view depicting a single facer according to one embodiment of the present invention.
Figure 2:
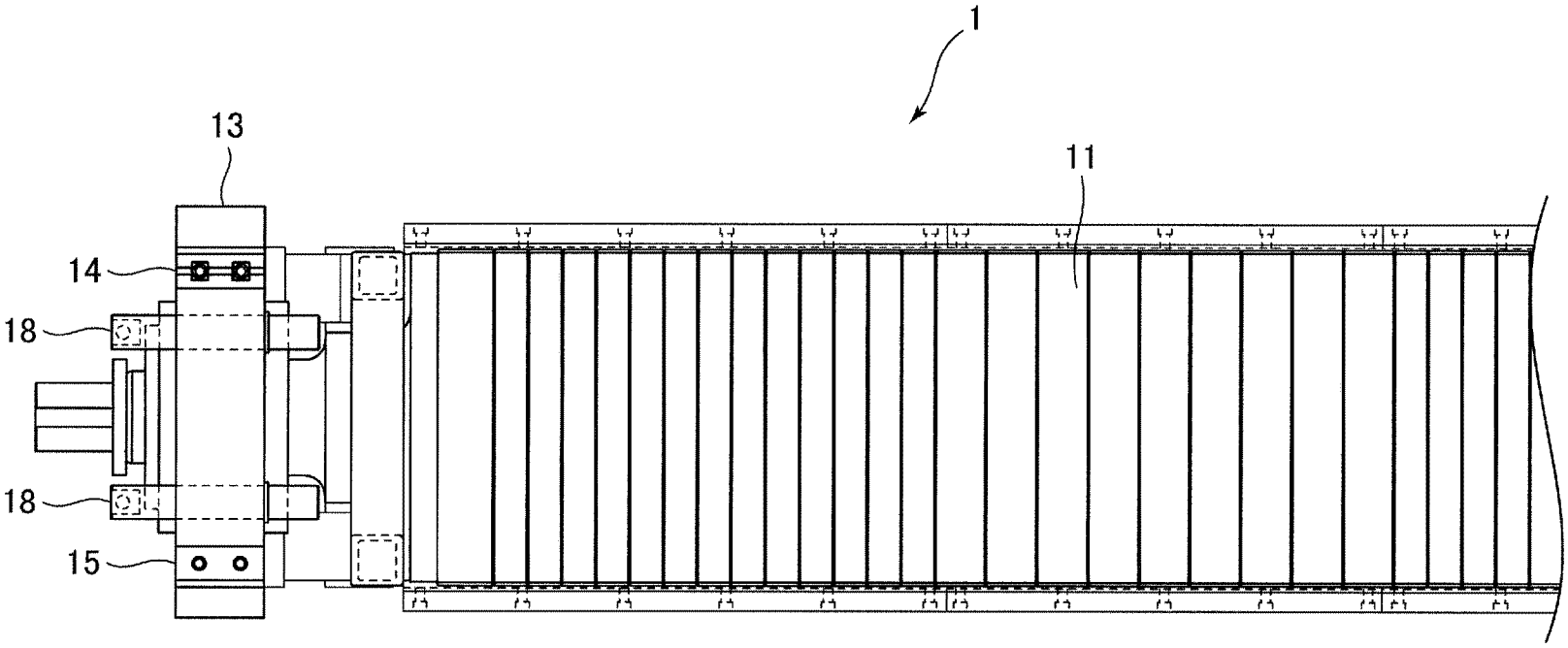
FIG. 2 is a fragmentary top view depicting a cartridge of the single facer according to this embodiment.
Figure 3:
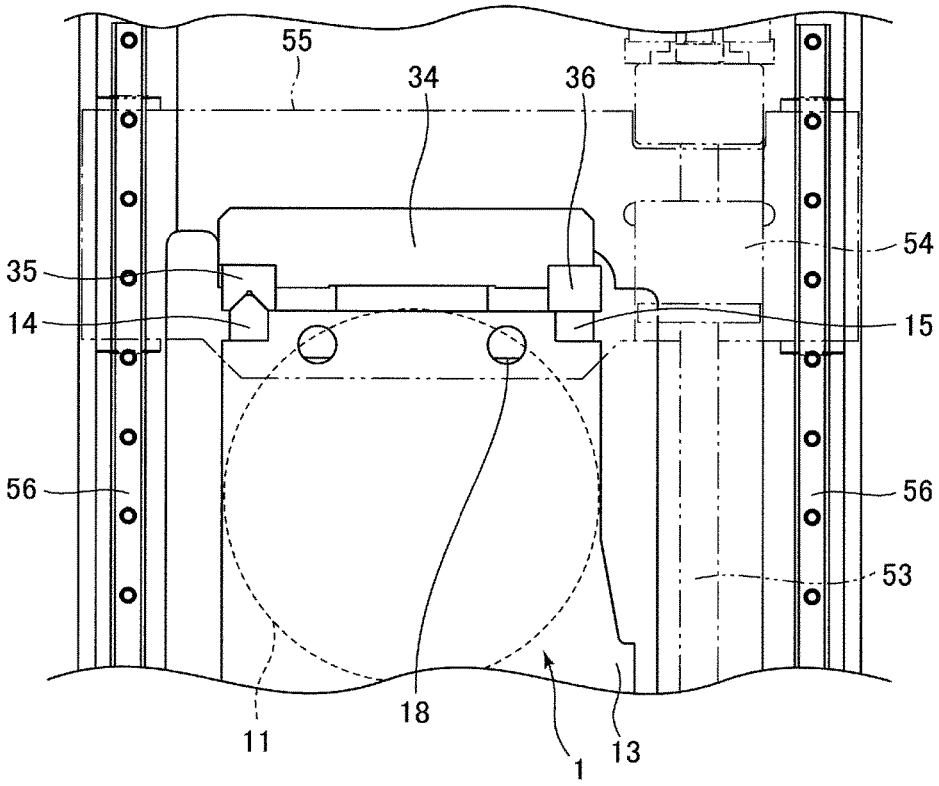
FIG. 3 is a fragmentary enlarged front view depicting the single facer according to this embodiment.
Figure 4:
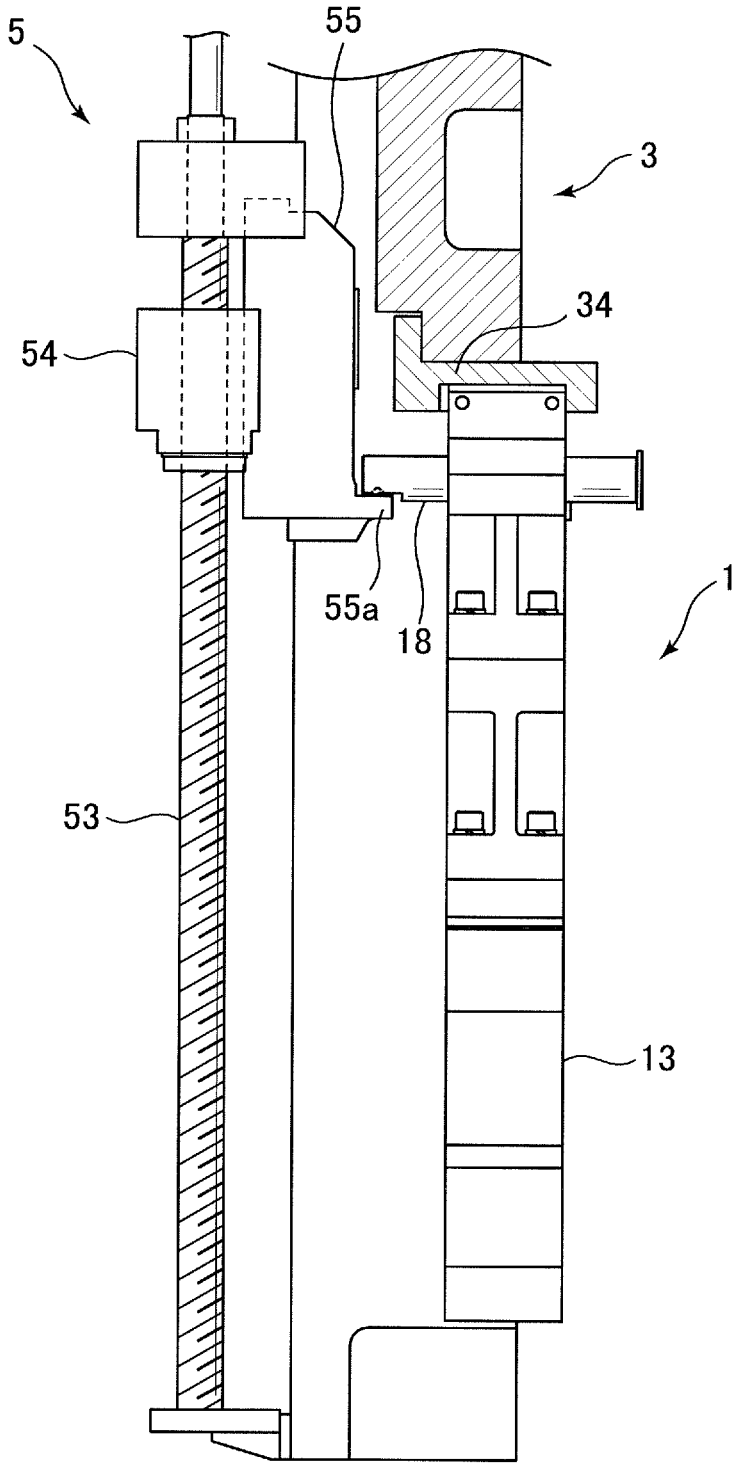
FIG. 4 is a fragmentary enlarged side view depicting the single facer according to this embodiment.
Figure 5:
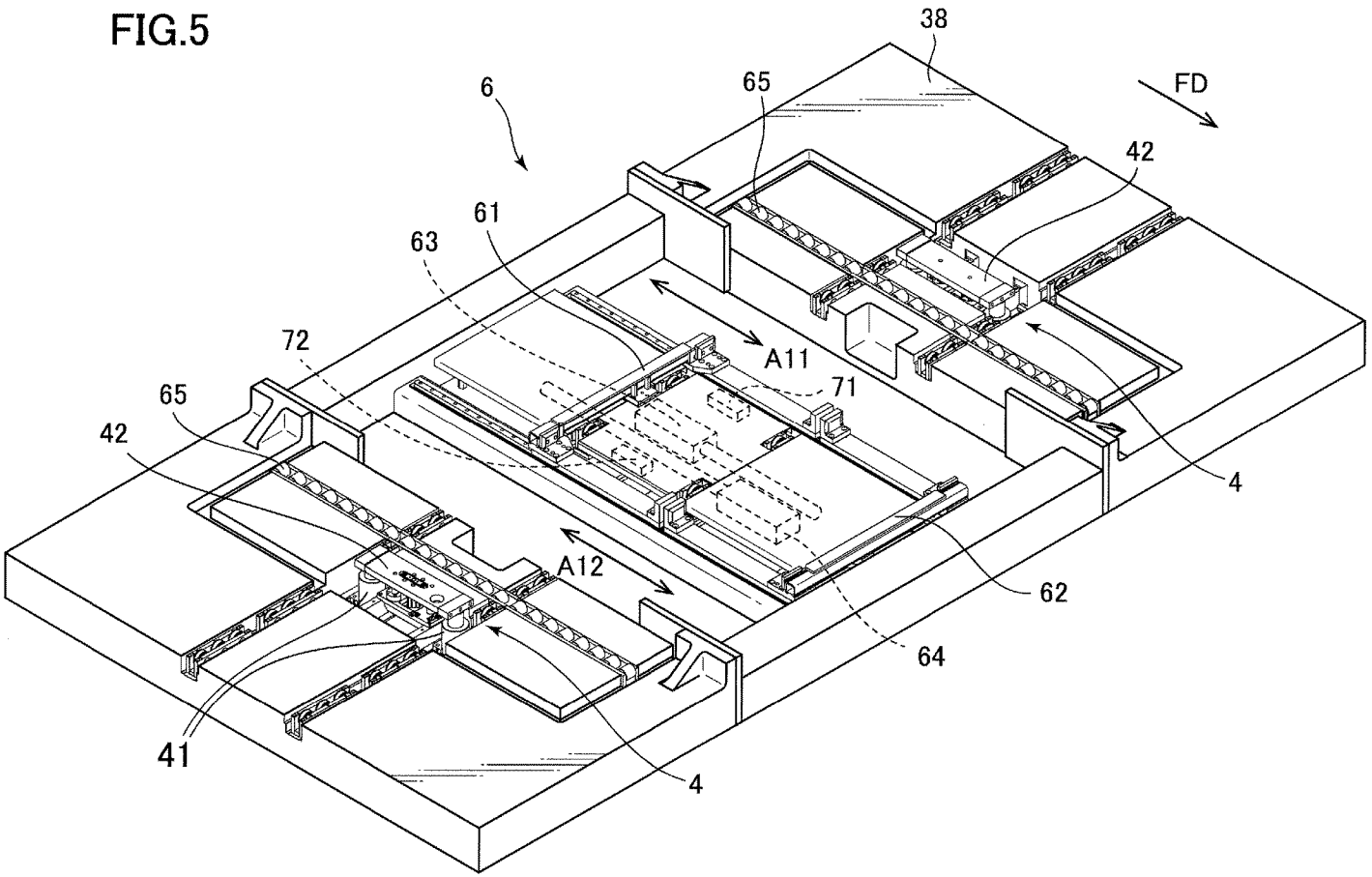
FIG. 5 is a perspective view depicting a bottom member of a single facer body of the single facer according to this embodiment.

First of all, with reference to FIGS. 1 to 5, a basic structure of the single facer according to this embodiment will be described. FIG. 1 is a front view depicting the single facer according to this embodiment. FIG. 2 is a fragmentary top view depicting a cartridge of the single facer according to this embodiment. FIG. 3 is a fragmentary enlarged front view depicting the single facer according to this embodiment (specifically, a fragmentary enlarged front view of a contact region between an upper edge of a side plate of the cartridge and a lower end of a ceiling member of a single facer body and the vicinity thereof). FIG. 4 is a fragmentary enlarged side view depicting the single facer according to this embodiment (specifically, an engagement region between the cartridge and a lifting-lowering mount of a vertically moving device and the vicinity thereof). FIG. 5 is a perspective view depicting a bottom member of a single facer body of the single facer according to this embodiment. FIGS. 1 to 3 depict the single facer 100, when viewed from a direction orthogonal to a single-faced corrugated paperboard sheet conveyance direction FD. Further, FIGS. 1 to 3 depict the single facer 100 during a normal running.

The single facer 100 is an apparatus for bonding a planar back linerboard to flute tips of a corrugated medium formed in a flute (waved flute) configuration to produce a single-faced corrugated paperboard sheet (In FIG. 1 and other figures, the corrugated medium, the back linerboard and the single-faced corrugated paperboard sheet are not depicted). Specifically, as depicted in FIG. 1, the single facer 100 comprises: a cartridge 1 pivotally supporting axially opposite ends of each of a pair of corrugating rolls 11, 12 for forming a corrugating medium web into a corrugated medium having a given flute configuration; a cartridge 2 pivotally supporting axially opposite ends of each of a pair of corrugating rolls 21, 22 for forming a corrugating medium web into a corrugated medium having a different flute configuration from that formed by the corrugating rolls 11, 12, wherein the cartridge 1 is stacked on the cartridge 2; and a single facer body 3 housing the cartridges 1, 2 in a movable manner. The single facer 100 further comprises: a hydraulic jack 4 serving as a pushing device for pushing the cartridge 2 upwardly; a vertically moving device 5 for moving (lifting and lowering) each of the cartridges 1, 2 in a vertical (upward-downward) direction; and a horizontally moving device 6 for moving each of the cartridges 1, 2 in a horizontal direction parallel to the single-faced corrugated paperboard sheet conveyance direction FD (this horizontal direction will hereinafter be referred to occasionally as "the specific horizontal direction") (see FIG. 5).

In the following description, when each of the cartridge 1 and the cartridge 2 is used without discriminating therebetween, it will be expressed simply as "the cartridge", by omitting the reference signs, and, when each of the corrugating roll pair (11, 12) and the corrugating roll pair (21, 22) is used without discriminating therebetween, it will be expressed simply as "the corrugating roll pair", by omitting the reference signs.

Further, as used in this specification, the term "in-use position" means a position of the corrugating roll pair and the cartridge in the single facer 100 when they are used for production of a single-faced corrugated paperboard sheet, and the term "rest position" means of a position of the corrugating roll pair and the cartridge in the single facer 100 when they are in a resting state without being used for production of a single-faced corrugated paperboard sheet. In the following description, the cartridge which is being used for production of a single-faced corrugated paperboard sheet will be referred to as "in-use cartridge", and the cartridge which is in the rest state without being used for production of a single-faced corrugated paperboard sheet will be referred to as "rest cartridge". For example, in FIG. 1, the cartridge 1 corresponds to the in-use cartridge, and the cartridge 2 corresponds to the rest cartridge. Further, the term "retraction position" means a position to which the cartridge is to be temporarily retracted during an operation of exchanging the corrugating roll pair to be used, and the term "lifting-lowering position" means a position which is located just below the rest position and in adjacent relation to the retraction positions in the specific horizontal direction, and a position from and to which the cartridge is lifted and lowered by the vertically moving device 5.

The cartridge 1 of the single facer 100 comprises: a pair of side plates 13 formed in a flat plate shape (in FIGS. 1 to 4, only one of the side plates 13 is depicted) to which opposite ends of the corrugating roll pair (11, 12) are pivotally mounted, respectively; and a bottom (not depicted) to which respective lower ends of the pair of side plates 13 are attached. Each of the side plates 13 of the cartridge 1 has: a protruding portion 14 formed at one edge of an upper end thereof to protrude upwardly and have a taper shape (specifically, a chevron shape, i.e., an upside-down V shape); a flat portion 15 formed at the other edge of the upper end located on an opposite side with respect to the one end formed with the protruding portion 14; a taper-shaped (specifically, an upside-down V-shaped) recessed portion 16 and a convex portion 19 formed, respectively, at opposite edges of a lower end thereof each corresponding to a respective one of the edges formed with the protruding portion 14 and the flat portion 15; and two stepped portions 17*a*, 17*b* formed, respectively, on opposite lateral ends thereof (see FIGS. 1 and 3). More specifically, each of the protruding portion 14 and the recessed portion 16 is formed at the edge end of the side plate 13 on an upstream side in the single-faced corrugated paperboard sheet conveyance direction FD (hereinafter referred to simply as "sheet conveyance direction FD"), and each of the flat portion 15 and the convex portion 19 is formed at the edge end of the side plate 13 on a downstream side in the sheet conveyance direction FD. Further, the stepped portions 17*a*, 17*b* are formed, respectively, on the lateral ends of the side plate 13 at respective positions offset in the vertical direction. The side plate 13 further has two projections 18 formed adjacent to the upper end thereof to protrude in a horizontal direction orthogonal to the sheet conveyance direction FD (see FIG. 2).

As with the cartridge 1, the cartridge 2 comprises: a pair of side plates 23 to which the corrugating roll pair (21, 22) is pivotally mounted; and a bottom (not depicted) to which the pair of side plates 13 are attached. Further, as with the side plate 13 of the cartridge 1, each of the side plates 23 of the cartridges 2 has a protruding portion 24, a flat portion 25, a recessed portion 26, a convex portion 29, two stepped portions 27*a*, 27*b* and two projections 28. On the other hand, in order to cope with two different flute configurations, two types of fluted portions having different configurations are formed, respectively, in an outer peripheral surface of each of the pair of corrugating rolls 11, 12 of the cartridge 1 and an outer peripheral surface of each of the pair of corrugating rolls 21, 22 of the cartridge 2. During running of the single facer 100, the cartridge 1 currently serving as the in-use cartridge is stacked on the cartridge 2 currently serving as the rest cartridge, and the cartridge 2 supports the cartridge 1 from therebelow. In this state, the recessed portion 16 and the convex portion 19 formed on the lower end of each of the side plates 13 of the cartridge 1 are engaged, respectively, with the protruding portion 24 and the flat portion 25 formed on the upper end of a corresponding one of the side plates 23 of the cartridge 2.

The single facer body 3 has an upper section formed as a gate-shaped frame so as to house and support the cartridges 1, 2 (see FIG. 1). The single facer body 3 is also formed with upstream-side and downstream-side horizontal transfer passages 31, 32 each for allowing the cartridge to be transferred in the horizontal direction parallel to the sheet conveyance direction FD, and a vertical transfer passage 33 for allowing the cartridge to be transfer in the vertical direction. The vertical transfer passage 33 intersects the horizontal transfer passages 31, 32 to form an inverted T shape. The cartridge 1 currently serving as the in-use cartridge is set up in the vertical transfer passage 33. On the other hand, the cartridge 2 currently serving as the rest cartridge is set up in an approximately central region of the horizontal transfer passages 31, 32 in the horizontal direction parallel to the sheet conveyance direction FD. The horizontal transfer passages 31, 32 define the lifting-lowering position just below the rest position in which the above rest cartridge is set up, and a retraction position for allowing the cartridge to be temporarily retracted during the operation of exchanging the corrugating roll pair to be used. Specifically, the downstream-side horizontal transfer passage 32 defines a retraction sub-position on a downstream side in the sheet conveyance direction FD, and the upstream-side horizontal transfer passage 31 defines a retraction sub-position on an upstream side in the sheet conveyance direction FD. The lifting-lowering position is provided in an approximately horizontally-central region of a space formed by the horizontal transfer passages 31, 32.

Further, the single facer body 3 comprises: a ceiling member 34 having a lower end formed with a taper-shaped (specifically, upside-down V-shaped) recessed portion 35 and a convex portion 36 having a flat distal end; and a bottom member 38 in which the hydraulic jack 4 and the vertically moving device 5 are installed. The recessed portion 35 of the ceiling member 34 is formed at a position corresponding to the protruding portion 14 of each of the side plates 13 and configured to be engaged with the protruding portion 14, and the convex portion 36 of the ceiling member 34 is formed at a position corresponding to the flat portion 15 of the side plate 13 (see FIG. 3). The upper section (including the ceiling member 34) of the single facer body 3 formed as a gate-shaped frame is integrally molded by casting or the like, wherein each of the recessed portion 35 and the convex portion 36 is formed as a separate member with respect to the integrally-molded member, and then bonded to the integrally-molded member. In this way, each of the recessed portion 35 and the convex portion 36 is formed of a material having a high hardness, and is improved in dimension accuracy. Similarly, each of the protruding portions 14 (24), the flat portion 15 (25), the recessed portion 16 (26) and the convex portion 19 (29) of the cartridge 1 (2) is formed as a separate member with respect to a plate body of the side plate 13 (23) to thereby ensure hardness and dimension accuracy thereof.

The hydraulic jack 4 is installed in the bottom member 38 of the single facer body 3 (see FIGS. 1 and 5). Specifically, the hydraulic jack 4 is installed in an approximately central region of the horizontal transfer passages 31, 32 in the horizontal direction parallel to the sheet conveyance direction FD. The hydraulic jack 4 comprises two actuating pins 41 configured to be lifted and lowered according to a hydraulic pressure applied thereto, and a loading table 42 coupled to distal ends of the two actuating pins 41 and configured to allow the cartridge 2 currently serving as the rest cartridge to be placed thereon. The hydraulic jack 4 is provided in the bottom member 38 of the single facer body 3 in the number of two (see FIG. 5), wherein the two hydraulic jacks 4 are arranged such that two loading table 42 thereof support two areas of the bottom of the cartridge 2, respectively.

When the actuating pins 41 of the hydraulic jacks 4 are actuated to rise upwardly in a state in which the stacked cartridges 1, 2 are placed on the loading table 42, the cartridge 2 is pushed upwardly, and the upper end of each of the side plates 13 of the cartridge 1 is pressed against the lower end of the ceiling member 34 of the single facer body 3. In this case, the protruding portion 14 formed on the upper end of the side plate 13 is first fitted into the recessed portion 35 formed on the lower end of the ceiling member 34. Then, in this state, when the cartridge 1 is further moved upwardly, the protruding portion 14 of the side plate 13 is pressed against a taper surface of the recessed portion 35 of the ceiling member 34, so that a corrective displacement of the side plate 13 in the sheet conveyance direction FD occurs. Then, when the protruding portion 14 reaches a deepest area (uppermost area) of the recessed portion 35, the flat portion 15 formed on the upper end of the side plate 13 is brought into surface contact with and pressed against the convex portion 36 formed on the lower end of the ceiling member 34 (see FIG. 3). Thus, in terms of the vertical direction, the stacked cartridges 1, 2 are clamped by the hydraulic jacks 4 and the ceiling member 34 of the single facer body 3, so that movements of the stacked cartridges 1, 2 in the vertical direction and the sheet conveyance direction FD are restricted.

As mentioned above, when the stacked cartridges 1, 2 are pushed by the hydraulic jacks 4 and clamped by the hydraulic jacks 4 and the ceiling member 34 of the single facer body 3, the taper-shaped protruding portion 14 formed on the upper end of each of the side plates 13 of the cartridge 1 is engaged with the taper-shaped recessed portion 35 formed on the lower end of the ceiling member 34. Through the engagement between the protruding portion 14 and the recessed portion 35, it becomes possible to perform vertical and horizontal positionings of the stacked cartridges 1, 2 with respect to the single facer body 3. Thus, the protruding portion 14 and the recessed portion 35 function as a positioning mechanism.

In the single facer body 3, a pair of clamp mechanisms 37*a*, 37*b* each serving as a protrusion-shaped member are provided in an approximately vertically-central region of the vertical transfer passage 33, correspondingly to each of the side plates 13, in such a manner as to be moved forwardly and backwardly with respect to an inside of the vertical transfer passage 33 (see FIG. 1). The clamp mechanisms 37*a*, 37*b* are provided at respective positions offset from each other in the vertical direction, and each of them is configured to actuate a claw by a non-depicted fluid-pressure cylinder or the like. When each of the claws of the clamp mechanisms 37*a*, 37*b* protrudes into the inside of the passage 33, it is disposed just below a corresponding one of the stepped portions 17*a*, 17*b* of the side plate 13 of the cartridge 1 currently serving as the in-use cartridge. In this state, a distal end of each of the claws of the clamp mechanisms 37*a*, 37*b* is brought into contact with the lateral end of the side plate 13 at a position just below the corresponding one of the stepped portions 17*a*, 17*b*. Thus, the cartridge 1 is clamped by the clamp mechanisms 37*a*, 37*b* in the horizontal direction parallel to the sheet conveyance direction FD, so that a movement of the cartridge 1 in this horizontal direction is restricted. When the clamp mechanisms 37*a*, 37*b* are in the protruded state, an upper surface of each of the claws of the clamp mechanisms 37*a*, 37*b* is disposed oppose to a lower surface of the corresponding one of the stepped portions 17*a*, 17*b*. However, fundamentally, these surfaces are spaced apart from each other without any contact therebetween.

The vertically moving device 5 is provided in the upper section of the single facer body 3, correspondingly to each of the side plates 13 (see FIG. 1). The vertically moving device 5 comprises: a drive motor 51 provided in the vicinity of an upper end of the single facer body 3; a lifting-lowering threaded shaft 53 extending from the upper end of the single facer body 3 to a lower end of the vertical transfer passage 33; a lifting-lowering nut 54 configured to be lifted and lowered along with a rotation of the lifting-lowering threaded shaft 53; and a lifting-lowering mount 55 coupled to the lifting-lowering nut 54. Thus, the lifting-lowering mount 55 can be vertically moved along the vertical transfer passage 33 by a drive force of the drive motor 51 transmitted via the lifting-lowering threaded shaft 53 and the lifting-lowering nut 54. The vertically moving device 5 further comprises a guide rail 56 attached to the single facer body 3 to extend from the upper end of the single facer body 3 to the lower end of the vertical transfer passage 33. This guide rail 56 is configured to guide the movement of the lifting-lowering mount 55. Further, as illustrated in FIG. 4, the lifting-lowering mount 55 is formed with a protrusion-shaped engagement portion 55*a* engageable with the projections 18 formed on the side plate 13 of the cartridge 1 currently serving as the in-use cartridge. When the lifting-lowering mount 55 is moved vertically in a state in which the protrusion-shaped engagement portion 55*a* of the lifting-lowering mount 55 is engaged with the projections 18 on the side plate 13 of the cartridge 1, the cartridge 1 is moved vertically along with the movement of the lifting-lowering mount 55.

During running of the single facer 100 (see FIG. 1), the cartridge 1 is pushed by the hydraulic jacks 4 and thereby clamped by the hydraulic jacks 4 and the ceiling member 34 of the single facer body 3, and the projections 18 on the side plate 13 of the cartridge 1 are spacedly located above the protrusion-shaped engagement portion 55*a* of the lifting-lowering mount 55, i.e., the projections 18 are not engaged with the protrusion-shaped engagement portion 55*a*. During a cartridge exchanging operation, when the pushing of the hydraulic jacks 4 is stopped to lower the loading table 42, the cartridge 1 is also lowered, and the projections 18 on the side plate 13 are engaged with the protrusion-shaped engagement portion 55*a* of the lifting-lowering mount 55, as depicted in FIG. 4.

As depicted in FIG. 5, the horizontally moving device 6 is installed in the bottom member 38 of the single facer body 3. The horizontally moving device 6 comprises: two conveyance tables 61, 62 on which the cartridge is placed when it is moved in the specific horizontal direction (the cartridge is placed on only one of the conveyance tables 61, 62); two hydraulic cylinders 63, 64 for moving the conveyance tables 61, 62, respectively; and a plurality of rollers 65 for supporting the bottom of the cartridge when it is moved in the specific horizontal direction. The conveyance table 61 is moved in two directions indicated by the arrowed line A11 (specifically, two directions along the horizontal transfer passage 31), and used when the cartridge is moved between the lifting-lowering position and the retraction position of the horizontal transfer passage 31 (see FIG. 1). The conveyance table 62 is moved in two directions indicated by the arrowed line A12 (specifically, two directions along the horizontal transfer passage 32), and used when the cartridge is moved between the lifting-lowering position and the retraction position of the horizontal transfer passage 32 (see FIG. 1). As above, the conveyance table 62 and the hydraulic cylinder 64 is equivalent to a first moving device, and the conveyance table 61 and the hydraulic cylinder 63 is equivalent to a second moving device.

During running of the single facer 100, an upper surface of the loading table 42 of each of the hydraulic jacks 4 which push the stacked cartridges 1, 2 to clamp them between the hydraulic jacks 4 and the ceiling member 34 of the single facer body 3 is set at a position above an upper surface of each of the conveyance tables 61, 62 of the horizontally moving device 6. Thus, during running of the single facer 100, a bottom surface of the cartridge 2 is spaced apart from the upper surface of each of the conveyance tables 61, 62 of the horizontally moving device 6, so that the cartridge 2 is placed on only the loading tables 42 of the hydraulic jacks 4 but not placed on the conveyance tables 61, 62. On the other hand, during the cartridge exchanging operation, when the pushing of the hydraulic jacks 4 is stopped, the loading tables 42 of the hydraulic jacks 4, and each of the surfaces of the loading tables 42 is set at a position below the upper surfaces of the conveyance tables 61, 62 of the horizontally moving device 6. Thus, the cartridge 2 lowered along with lowering of the loading tables 42 of the hydraulic jacks 4 is placed on the conveyance tables 61, 62 (specifically, one of the conveyance tables 61, 62) of the horizontally moving device 6.

Further, two proximity sensors 71, 72 each serving as a position sensor are provided in the vicinity of the hydraulic cylinders 63, 64 of the horizontally moving device 6, respectively, as depicted in FIG. 5. Each of the proximity sensors 71, 72 is operable to detect a position of a movable member comprised in a respective one of the hydraulic cylinders 63, 64 and for moving the corresponding one of the conveyance tables 61, 62 (i.e., the position uniquely corresponds to a position of the corresponding conveyance table). Specifically, a sensor dog (not depicted) is attached to each of the movable portions of the hydraulic cylinders 63, 64, and each of the proximity sensors 71, 72 is configured such that, when the sensor dog attached to the movable portion of a corresponding one of the hydraulic cylinders 63, 64 becomes proximate thereto, to output a signal indicative of closest proximity to the sensor dog. Thus, the proximity sensors 71, 72 and the sensor dogs may be arranged at respective positions which allow the proximity sensors 71, 72 to detect whether or not the conveyance tables 61, 62 are located at predetermined positions. This makes it possible to allow the horizontally moving device 6 to accurately set the cartridge to a predetermined horizontal position by monitoring outputs of the proximity sensors 71, 72. This predetermined horizontal position means a position in which the cartridge is set during production of a single-faced corrugated paperboard sheet, specifically an approximately central region of the horizontal transfer passages 31, 32 in the horizontal direction parallel to the sheet conveyance direction FD (see FIG. 1).

Next, a cartridge positioning operation during running of the single facer 100 will be described (see FIG. 1). In advance of running of the single facer 100, the cartridge 1 to be used as the in-use cartridge is staked on the cartridge 2 to be used as the rest cartridge, so that the cartridge (upper cartridge) 1 is supported from therebelow by the cartridge (lower cartridge) 2. In this state, the protruding portion 24 formed on the upper end of each of the side plates 23 of the cartridge 2 is engaged with the recessed portion 16 formed on the lower end of a corresponding one of the side plates 13 of the cartridge 1, to suppress a horizontal displacement between the cartridges 1, 2.

Then, the cartridges 1, 2 stacked in the above manner are placed on the loading tables 42 of the hydraulic jacks 4, and the actuating pins 41 of the hydraulic jacks 4 are actuated to push the stacked cartridges 1, 2 upwardly. In this way, the stacked cartridges 1, 2 are clamped by the hydraulic jacks 4 and the ceiling member 34 of the single facer body 3, to thereby restrict a vertical movement of the stacked cartridges 1, 2, i.e., perform vertical positioning of the stacked cartridges 1, 2. In this state, the protruding portion 14 formed on the upper end of the side plate 13 of the cartridge 1 is engaged with the recessed portion 35 formed on the lower end of the ceiling member 34, and the distal end of the convex portion 36 formed on the lower end of the ceiling member 34 is brought into contact with the flat portion 15 formed on the upper end of the side plate 13 of the cartridge 1, to thereby perform vertical and horizontal positionings of the cartridge with respect to the single facer body 3.

Further, the clamp mechanisms 37*a*, 37*b* of the single facer body 3 are activated to protrude into the inside of the passage 33, and the distal ends of the claws of the clamp mechanisms 37*a*, 37*b* are brought into contact, respectively, with the lateral ends of the side plate 13 of the cartridge 1 (at respective positions just below the stepped portions 17*a*, 17*b*). In this way, the cartridge 1 is clamped by the clamp mechanisms 37*a*, 37*b*, to thereby restrict the horizontal movement (perforin horizontal positioning) of the cartridge 1.

Figure 6:
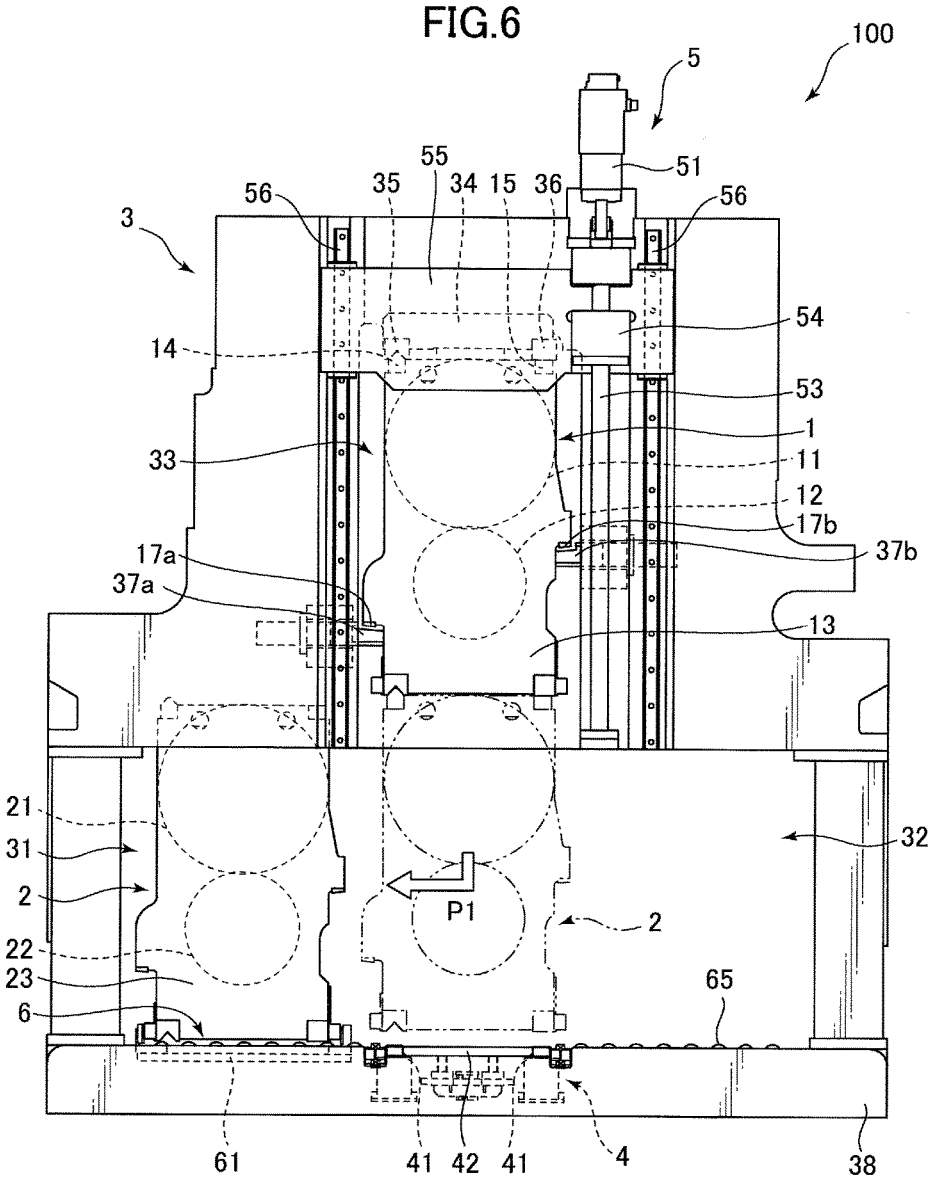
FIG. 6 is a front view depicting the single facer according to this embodiment, during a cartridge exchanging operation (step P1).
Figure 7:
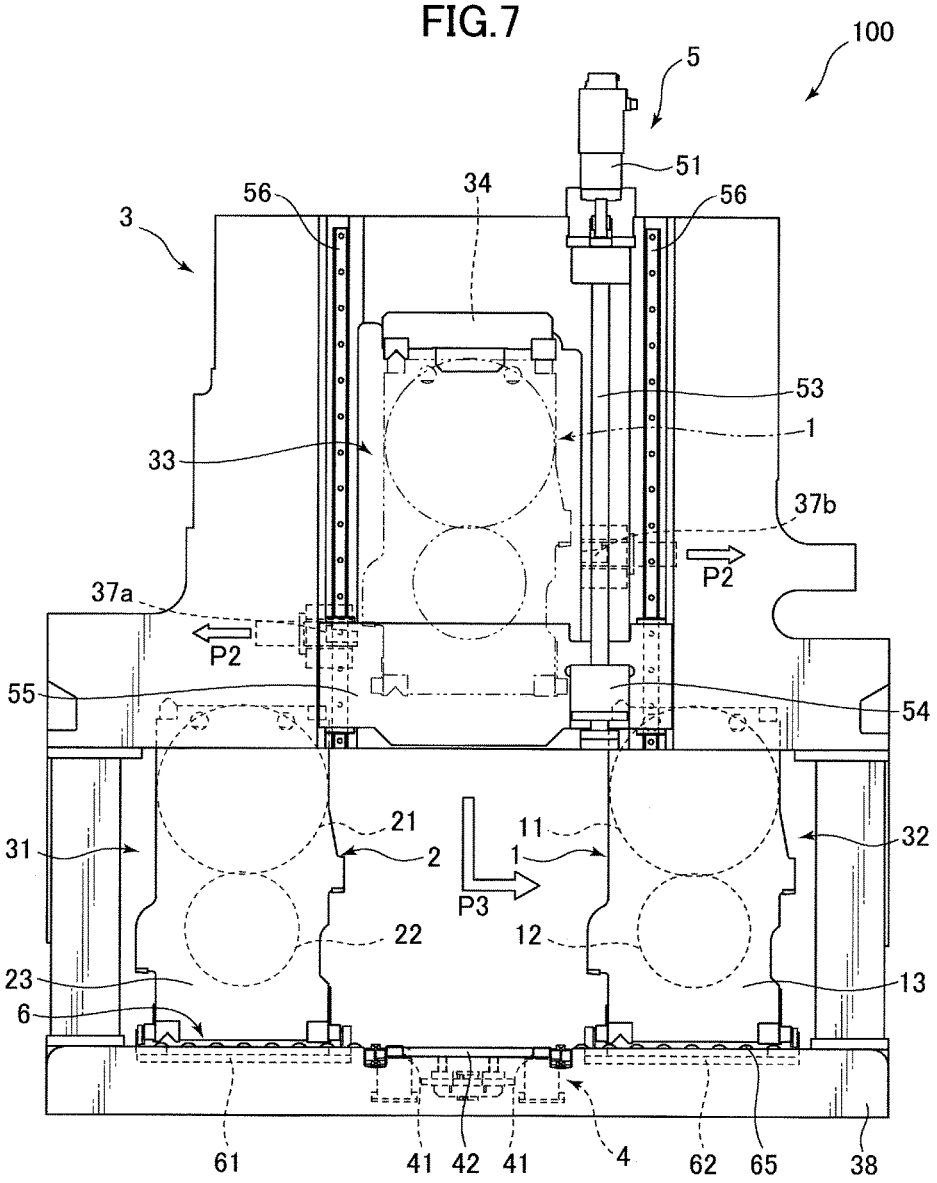
FIG. 7 is a front view depicting the single facer according to this embodiment, during the cartridge exchanging operation (steps P2 and P3).
Figure 8:
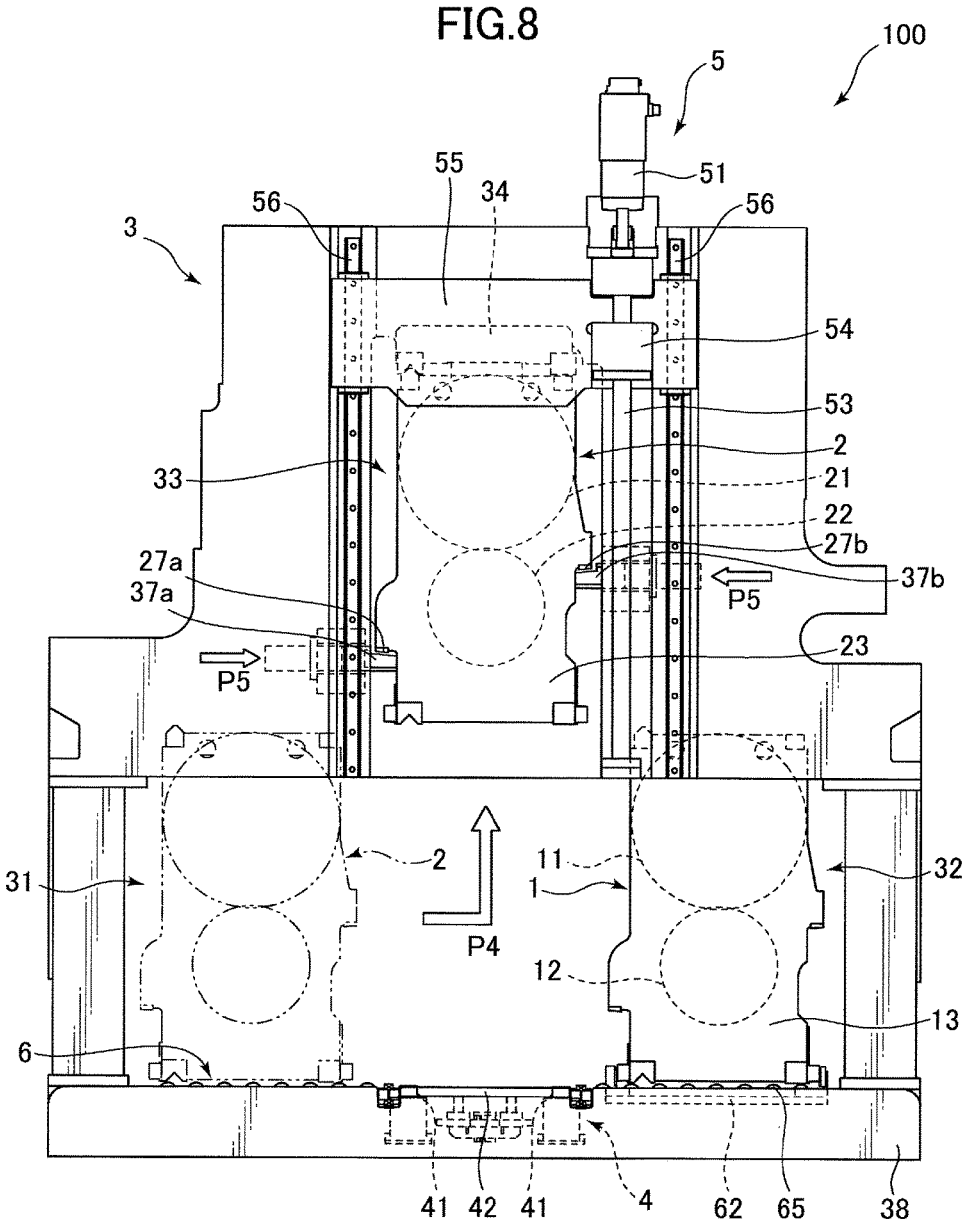
FIG. 8 is a front view depicting the single facer according to this embodiment, during the cartridge exchanging operation (steps P4 and P5).
Figure 9:
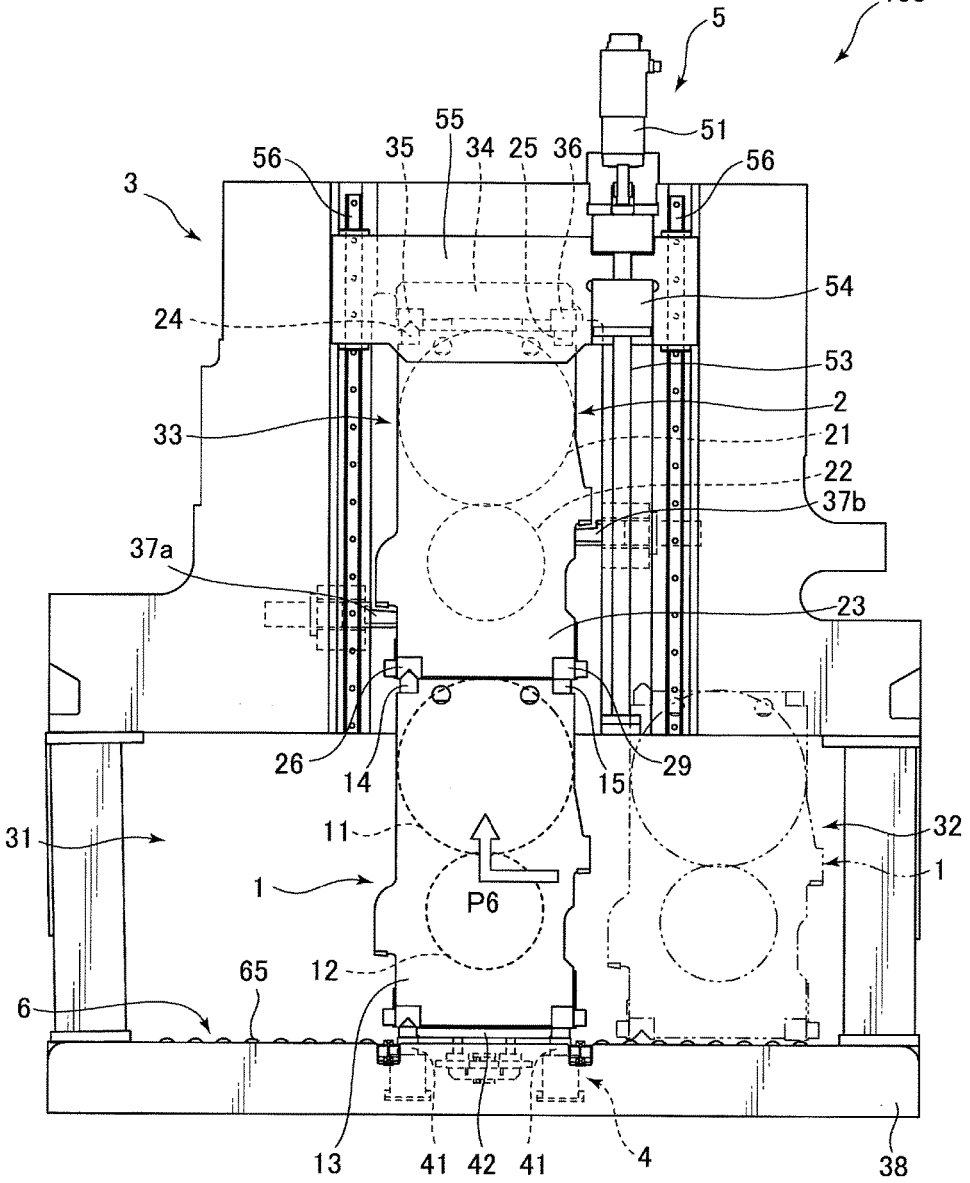
FIG. 9 is a front view depicting the single facer according to this embodiment, during the cartridge exchanging operation (step P6).

Next, with reference to FIGS. 6 to 9, the cartridge exchanging operation will be described in detail. FIGS. 6 to 9 are front views depicting the single facer 100 according to this embodiment. Specifically, FIG. 6 depicts a step P1 to be initially performed during the cartridges exchanging operation in the single facer 100 according to this embodiment, and FIG. 7 depicts steps P2 and P3 to be performed after the step P1 during the cartridges exchanging operation in the single facer 100 according to this embodiment. FIG. 8 depicts steps P4 and P5 to be performed after the step P3 during the cartridges exchanging operation in the single facer 100 according to this embodiment, and FIG. 9 depicts step P6 to be performed after the step P5 during the cartridges exchanging operation in the single facer 100 according to this embodiment.

First of all, as depicted in FIG. 6, the cartridge 2 (rest cartridge) is retracted to the retraction position defined by the upstream-side horizontal transfer passage 31 (step P1). Specifically, the actuating pins 41 of the hydraulic jacks 4 are firstly lowered to lower the loading tables 42 of the hydraulic jacks 4 supporting the cartridges 2. Thus, the cartridge 2 is moved from the rest position to the lifting-lowering position, and placed on the conveyance table 61 of the horizontally moving device 6 (see FIG. 5). Then, the conveyance table 61 is moved in a leftward (in FIG. 6) direction by the hydraulic cylinder 63 of the horizontally moving device 6, to thereby move the cartridge 2 to the retraction position in the horizontal transfer passage 31.

On the other hand, the cartridge 1 is held by the lifting-lowering mount 55 of the vertically moving device 5 during the step P1. Specifically, when the hydraulic jacks 4 are lowered, the cartridge 1 is slightly lowered together with the cartridge 2 (in this process, the upper ends of the side plates 13 of the cartridge 1 are spaced apart from the lower end of the ceiling member 34 of the single facer body 3), and the cartridge 1 is latched by the lifting-lowering mount 55 of the vertically moving device 5. Specifically, the projections 18 of each of the side plates 13 of the cartridge 1 are engaged with the protrusion-shaped engagement portion 55*a* of the lifting-lowering mount 55 (see FIG. 4). Thus, the cartridge 1 is held at a position slightly lowered from the in-use position. When the cartridge 1 is held by the lifting-lowering mount 55, the upper surfaces of the clamp mechanisms 37*a*, 37*b* provided in the single facer body 3 are spaced apart from the respective lower surfaces of the stepped portions 17*a*, 17*b* of the side plate 13 of the cartridge 1, so that the clamp mechanisms 37*a*, 37*b* do not contribute to the holding of the cartridge 1.

Subsequently, as depicted in FIG. 7, the cartridge 1 (in-use cartridge) is lowered to the lifting-lowering position just below the rest position, and then retracted to the retraction position defined in the downstream-side horizontal transfer passage 32 (steps P2 and P3). Specifically, in step P2, the claws of the clamp mechanisms 37*a*, 37*b* are moved backwardly to a position outside the vertical transfer passage 33. Subsequently, in step P3, the drive motor 51 of the vertically moving device 5 is driven to rotate the lifting-lowering threaded shaft 53 to thereby lower, to the lifting-lowering position, the cartridge 1 latched by the lifting-lowering mount 55. Thus, the cartridge 1 is placed on the conveyance table 62 of the horizontally moving device 6 (see FIG. 5). When the cartridge 1 is lowered to the lifting-lowering position and placed on the conveyance table 62 in the above manner, the latching of the cartridge 1 by the lifting-lowering mount 55 is released, and, more specifically, engagement of the projections 18 of the cartridge 1 by the protrusion-shaped engagement portion 55*a* of the lifting-lowering mount 55 is released. Then, the conveyance table 62 is moved in a rightward (in FIG. 7) direction by the hydraulic cylinder 64 of the horizontally moving device 6, to thereby move the cartridge 1 from the lifting-lowering position to the retraction position in horizontal transfer passage 32.

Subsequently, as depicted in FIG. 8, the cartridge 2 retracted in the horizontal transfer passage 31 is returned to the lifting-lowering position and lifted (steps P4 and P5). Specifically, in step P4, the conveyance table 61 is moved in the rightward (in FIG. 8) direction by the hydraulic cylinder 64 of the horizontally moving device 6, to thereby move the cartridge 2 from the retraction position in horizontal transfer passage 31 to the lifting-lowering position. In this process, it is desirable to determine whether or not the cartridge 2 is accurately moved to the lifting-lowering position by the hydraulic cylinder 64 of the horizontally moving device 6, while monitoring the output of the proximity sensor 71. Then, the drive motor 51 of the vertically moving device 5 is driven to rotate the lifting-lowering threaded shaft 53 to thereby lift the cartridge 2 latched by the lifting-lowering mount 55, to the in-use position (exactly, a position slightly below the in-use position). The latching of the cartridge 2 by the lifting-lowering mount 55, i.e., the engagement of the projections 28 of the cartridges 2 by the protrusion-shaped engagement portion 55*a* of the lifting-lowering mount 55, is performed when the lifting-lowering mount 55 starts to be lifted. Subsequently, in step P5, the claws of the clamp mechanisms 37*a*, 37*b* are actuated to protrude into the inside of the vertical transfer passage 33, and brought into contact, respectively, with the lateral ends of the side plate 23 at respective positions just below the stepped portions 27*a*, 27*b* of the cartridge 2.

Subsequently, as depicted in FIG. 9, the cartridge 1 retracted in the horizontal transfer passage 32 is moved to the lifting-lowering position to support the cartridge 2 lifted in the above manner (new in-use cartridge), from therebelow (step P6). Specifically, the conveyance table 62 is moved in the leftward (in FIG. 9) direction by the hydraulic cylinder 63 of the horizontally moving device 6, to thereby move the cartridge 1 from the retraction position in horizontal transfer passage 32 to the lifting-lowering position. In this process, it is desirable to determine whether or not the cartridge 1 is accurately moved to the lifting-lowering position by the hydraulic cylinder 63 of the horizontally moving device 6, while monitoring the output of the proximity sensor 72. Then, the actuating pins of the hydraulic jacks 4 and the loading tables 42 are lifted to thereby lift the cartridge 1 while placing the cartridge 1 on the loading tables 42. Thus, an upper end of the cartridge 1 is brought into contact with a lower end of the cartridge 2, and the cartridge 2 is lifted together with the cartridge 1. As a result, an upper end of the cartridge 2 is brought into contact with the lower end of the ceiling member 34 of the single facer body 3, so that an entirety of the stacked cartridges 2, 1 are clamped by the hydraulic jacks 4 and the ceiling member 34 of the single facer body 3. In this manner, the cartridge 2 is set to the in-use position, and the cartridge 1 is set to the rest position.

It should be understood that the step P5 depicted in FIG. 8 may be performed after the step P6 depicted in FIG. 9. That is, after moving the cartridge 1 from the retraction position to the lifting-lowering position, and pushing the stacked cartridges 2, 1 by the hydraulic jacks 4 to thereby clamp the stacked cartridges 2, 1 by the hydraulic jacks 4 and the ceiling member 34 of the single facer 3, the claws of the clamp mechanisms 37*a*, 37*b* may be actuated to protrude into the inside of the passage 33 and brought into contact, respectively, with the lateral ends of the side plate 23 of the cartridge 2 to thereby clamp the cartridge 2 by the clamp mechanisms 37*a*, 37*b*.

Next, an advantageous effect of the single facer 100 according to the above embodiment will be described. The following description about advantageous effects will be made on an assumption that the cartridge 1 and the cartridge 2 in the above embodiment are, respectively, the in-use cartridge and the rest cartridge, i.e., are in a setup state in which the cartridge 1 is stacked on the cartridge 2. It should be noted that the following advantageous effects can also be obtained in a situation where the cartridge 2 and the cartridge 1 are, respectively, the in-use cartridge and the rest cartridge.

In the single facer 100 according to the above embodiment, the cartridges 1, 2 in a stacked state are pushed upwardly by the hydraulic jacks 4, to thereby press the upper end of each of the side plates 13 of the cartridge 1 against the lower end of the ceiling member 34 of the single facer body 3 to clamp an entirety of the stacked cartridges 1, 2 by the hydraulic jacks 4 and the ceiling member 34 of the single facer body 3 as a heavy object. In this way, the entirety of the stacked cartridges 1, 2 can be stably fixed with respect to the single facer body 3 to restrict a vertical movement of the stacked cartridges 1, 2.

In the single facer 100 according to the above embodiment, it becomes possible to adequately suppress the influence of heat generated in the single facer 100. Specifically, in the technique described in the aforementioned Patent Document 1, due to thermal deformation of the single facer body and the cartridges caused by heat generated in the single facer, there is a possibility that the corrugating rolls of the in-use cartridge cannot be fixed in an adequate position during production of a single-faced corrugated paperboard sheet. In contrast, the single facer according to the above embodiment employing the hydraulic jacks 4 for pushing the stacked cartridges 1, 2 upwardly can adequately suppress the influence of thermal deformation, even if such thermal deformation occurs. More specifically, in the above embodiment, a vertical misalignment between the single facer body 3 and the stacked cartridges 1, 2 caused by thermal deformation can be absorbed by adjusting a vertical movement amount of the actuating pins 41 and loading tables 42 of the hydraulic jacks 4. Typically, when the upper section of the single facer body 3 is thermally expanded, and a position of the lower end of the ceiling member is lowered, the vertical movement amount of the hydraulic jacks 4 is reduced to reduce a lift amount of the stacked cartridges 1, 2. As above, the single facer 100 according to the above embodiment can suppress the influence of heat generated therein to fix the corrugating rolls of the in-use cartridge in an adequate position during production of a single-faced corrugated paperboard sheet.

In the above embodiment, the protruding portion 14 is formed on the upper end of the side plate 13 of the cartridge 1, and the recessed portion 35 is formed on the lower end of the ceiling member 34 of the single facer body 34. Thus, when the hydraulic jacks 4 push the stacked cartridges 1, 2 upwardly, the protruding portion 14 and the recessed portion 35 can be used as a positioning mechanism so as to adequately perform the horizontal positioning of the stacked cartridges 1, 2 with respect to the single facer body 3. Particularly, in the above embodiment, the protruding portion 14 of the cartridge 1 provided at one edge of the upper end of each of the side plates 13 is formed in a taper shape, and the recessed portion 35 in the ceiling member 34 of the single facer body 3 is formed in a taper shape. Thus, even in a situation where the single facer body 3 and the stacked cartridges 1, 2 undergo thermal deformation, positioning of the stacked cartridges 1, 2 with respect to the single facer body 3 can be reliably performed.

In the above embodiment, the flat portion 15 is formed on the upper end of each of the side plates 13 of the cartridge 1 at the other edge of the upper end located on an opposite side with respect to the one end formed with the protruding portion 14, and the convex portion 36 is formed on the lower end of the ceiling member 34 of the single facer body 3 at a position corresponding to the flat portion 15, whereby, when the hydraulic jacks 4 push the stacked cartridges 1, 2 upwardly, the convex portion 36 on the ceiling member 34 of the single facer body 3 is brought into surface contact with the flat portion 15 of the cartridge 1. In this case, a contact between the upper end of the side plate 13 of the cartridge 1 and the lower end of the ceiling member 34 of the single facer body 3 occurring when the hydraulic jacks 4 push the stacked cartridges 1, 2 upwardly is established by a contact in an engaged region between the protruding portion 14 of the cartridge 1 and the recessed portion 35 of the ceiling member 34, and a surface contact between the flat portion 15 of the cartridge 1 and the convex portion 36 of the ceiling member 34.

Thus, in the above embodiment, it becomes possible to press the upper end of the side plate 13 of the cartridge 1 against the lower end of the ceiling member 34 of the single facer body 3 by the pushing of the hydraulic jacks 4 to adequately clamp the stacked cartridges 1, 2 by the hydraulic jacks 4 and the ceiling member 34 of the single facer body 3. Particularly, each of the protruding portion 14 and the flat portion 15 of the cartridge 1 and the recessed portion 35 and the convex portion 36 of the ceiling member 34 is formed as a separate member having assured hardness and dimensional accuracy. Thus, the upper end of the side plate 13 of the cartridge 1 can be brought into contact with the lower end of the ceiling member 34 of the single facer body 3 through these portions to provide enhanced accuracy in positioning of the stacked cartridges 1, 2 when being clamped by the hydraulic jacks 4 and the ceiling member 34 of the single facer body 3.

In the present invention, the clamp mechanisms 37*a*, 37*b* provided in the single facer body 3 are actuated to protrude into the inside of the passage 33 and brought into contact, respectively, with the lateral ends of the side plate 13 of the cartridge 1, so that it becomes possible to adequately restrict a horizontal movement of the stacked cartridges 1, 2. This makes it possible to suppress a shock load occurring in the specific horizontal direction when a jointed region formed between two webs to have an increased thickness passes between the corrugating rolls 9 in the single facer 100.

In the above embodiment, the stepped portions 17*a*, 17*b* are formed, respectively, on the opposite lateral ends of the side plate 13 of the cartridge 1 at positions above respective contact positions with the clamp mechanisms 37*a*, 37*b*. Thus, for example, in a situation where the cartridge 2 is retracted, and in this state, the cartridge 1 latched by the lifting-lowering mount 55 is subjected to maintenance (see FIG. 6), even when the latching of the cartridge 1 is released for some reason, the clamp mechanisms 37*a*, 37*b* are engaged with corresponding ones of the stepped portions 17*a*, 17*b* of the cartridge 1, so that it becomes possible to prevent dropping of the cartridge 1.

In addition, the clamp mechanisms 37*a*, 37*b* and the stepped portion 17*a*, 17*b* are formed such that the upper surface of each of the claws of the clamp mechanisms 37*a*, 37*b* being in the protruded position is located in spaced-apart relation to the lower surface of a corresponding one of the stepped portion 17*a*, 17*b*. Thus, even when the single facer body 3 and the stacked cartridges 1, 2 are thermally deformed, it becomes possible to suppress the problem occurring between the clamp mechanism and the lockable seat in the single facer disclosed in the Patent Document 1. Specifically, even when the single facer body 3 and the stacked cartridge 1, 2 undergo thermal deformation, it becomes possible to adequately suppress a situation where the clamp mechanisms 37*a*, 37*b* and the stepped portions 17*a*, 17*b* hinder the positioning of the stacked cartridges 1, 2 with respect to the single facer body 3.

In the above embodiment, the proximity sensors 71, 72 are provided to detect respective horizontal positions of the cartridges 1, 2. Thus, the horizontally moving device 6 can accurately set up each of the cartridges 1, 2 in the given horizontal position by using the proximity sensors 71, 72.

In the above embodiment, each of the cartridges 1, 2 is moved between the lifting-lowering position and a corresponding one of the two retraction positions by using the conveyance table 61 and the hydraulic cylinder 63 as a first moving device and using the conveyance table 62 and the hydraulic cylinder 64 as a second moving device, so that it becomes possible to efficiently exchange the cartridges 1, 2 between the in-use position and the two rest positions. In addition, in the above embodiment, the first and second moving devices are composed, respectively, of hydraulic cylinders 63, 64, so that it becomes possible to adequately set up each of the two heavy cartridges 1, 2 in a given horizontal position, and adequately install the first and second moving devices in the bottom member of the single facer body 3 limited in space.

In the above embodiment, the stacked cartridges 1, 2 are pushed upwardly by the hydraulic jacks 4, and clamped by the hydraulic jacks 4 and the ceiling member 34 of the single facer body 3. However, the present invention is not limited to pushing by means of such a hydraulic jack, but any suitable pushing device other than a hydraulic jack may be used to push the stacked cartridges 1, 2 upwardly.

What is claimed is:

1. A single facer for bonding a linerboard to a corrugated medium formed in a flute configuration to produce a single-faced corrugated paperboard sheet, comprising:

a set of two cartridges configured to be stacked in a vertical direction during a production of a single-faced corrugated paperboard sheet in such a manner that they alternately take an upper, in-use position and a lower, rest position, respectively, wherein: one of the two cartridges comprises a pair of corrugating rolls for forming a single-faced corrugated paperboard sheet having a given flute configuration, and a side plate pivotally supporting the pair of corrugating rolls; and the other cartridge comprises a pair of corrugating rolls for forming a single-faced corrugated paperboard sheet having a different flute configuration from that of the one cartridge, and a side plate pivotally supporting the pair of corrugating rolls;

a single facer body housing the two cartridges in a movable manner so as to exchange respective setup positions of the two cartridges between the in-use position and the rest position; and a pushing device disposed just below the two cartridges stacked in the vertical direction and configured to push the stacked cartridges upwardly, wherein, by pushing the stacked cartridges upwardly by the pushing device, the single facer is operable to press an upper end of the side plate of an upper one of the stacked cartridges with respect to a lower end of a ceiling member of the single facer body, so as to clamp an entirety of the stacked cartridges by the pushing device and the ceiling member of the single facer body.

2. The single facer according to claim 1, wherein the upper end of the side plate of each of the cartridges and the lower end of the ceiling member of the single facer body are formed with a positioning mechanism for positioning the upper cartridge with respect to the ceiling member of the single facer body when the pressing device pushes the stacked cartridges upwardly.

3. The single facer according to claim 2, wherein the positioning mechanism comprises:

a protruding portion formed at an edge of the upper end of the side plate of each of the cartridges; and a recessed portion formed on the lower end of the ceiling member of the single facer body at a position corresponding to the protruding portion, and configured to be engaged with the protruding portion, wherein both the protruding portion and the recessed portion are formed in taper shapes.

4. The single facer according to claim 3, wherein the upper end of the side plate of each of the cartridges is further formed with a flat portion at one edge opposite to the other edge formed with the protruding portion, as viewed in a sheet conveyance direction by the single facer, wherein the lower end of the ceiling member of the single facer body is further formed with a convex portion at a position corresponding to the flat portion, and wherein the convex portion is configured to come into surface contact with the flat portion when the pressing device pushes the stacked cartridges upwardly.

5. The single facer according to claim 1, wherein the single facer body is provided with a protrusion-shaped member movable forwardly and backwardly with respect to a lateral end of the side plate of the upper cartridge, wherein a distal end of the protrusion-shaped member comes into contact with the lateral end of the side plate when the protrusion-shaped member is in a protruded position, and wherein the lateral end of the side plate of each of the cartridges is formed with a stepped portion which is located just above a position corresponding to the protrusion-shaped member, and which includes a surface spacedly opposed to an upper surface of the protrusion-shaped member being in the protruded position.

6. The single facer according to claim 1, further comprising:

a vertically moving device for lifting and lowering the cartridges so as to alternately set up the cartridges in the in-use position and the rest position;

a horizontally moving device for moving the cartridges in a horizontal direction parallel to a sheet conveyance direction by the single facer to temporarily retract the cartridge to a retraction position within the single facer body, so as to exchange vertical setup positions regarding the stacked cartridges; and a position sensor for detecting whether or not each of the two cartridges is set up by the horizontally moving device at a given horizontal position to be set up during the production of the single-faced corrugated paperboard sheet.

7. The single facer according to claim 6, wherein the horizontally moving device comprises: a first moving device for moving one of the two cartridges between a lifting-lowering position for lifting and lowering the cartridge by the vertically moving device, and a first retracted sub-position of the retraction position on a downstream side in the sheet conveyance direction; and a second moving device for moving the other cartridge between the lifting-lowering position and a second retracted sub-position of the retraction position on an upstream side in the sheet conveyance direction, and wherein both the first and second moving devices are provided in a bottom member of the single facer body, and configured to move the cartridge by a hydraulic cylinder.

* * * * *